US005397412A

United States Patent [19]

Lee

[11] Patent Number: 5,397,412

[45] Date of Patent: Mar. 14, 1995

[54] PROCESS FOR MANUFACTURING YARN FROM WHEAT STRAWS

[76] Inventor: Nam-Seung Lee, 110 Seogye-dong, Yongsan-ku, Seoul, Rep. of Korea

[21] Appl. No.: 213,731

[22] Filed: Mar. 16, 1994

[30] Foreign Application Priority Data

Mar. 27, 1993 [KR] Rep. of Korea ..... 934886

[51] Int. Cl.[6] ..... B32B 9/02

[52] U.S. Cl. ..... 156/166; 156/180

[58] Field of Search ..... 156/157, 158, 159, 259, 156/265, 166, 180; 428/264, 166, 180

[56] References Cited

U.S. PATENT DOCUMENTS 2,689,813 9/1954 Lawrence ..... 156/180
2,743,573 5/1956 Hiensoh ..... 156/180
4,395,871 8/1983 Smid et al. ..... 57/286

*Primary Examiner*—Michael W. Ball
*Assistant Examiner*—Sam Chuan Yao
*Attorney, Agent, or Firm*—Ezra Sutton

[57] ABSTRACT

The invention discloses a process for manufacturing yarns from wheat straws. More specifically, the present invention relates to a process for manufacturing yarns from wheat straws, in which wheat straws that are capable of protecting human bodies from harmful spectra such as ultra-violet rays are finely cleaved to prepare yarns in a simple process for making hats, gowns, gloves and the like, so that workers working in the field can be protected from harmful spectra such as ultra-violet rays. The process for manufacturing yarns from wheat straws according to the present invention includes: a cutting step 10 for cutting off the nodes of the opposite ends wheat straws after flaying the skins and arranging them neatly; a cleaving step 20 for cleaving the cut pieces of the wheat straws so as for them to become rectangular forms; an adhesive spreading step 30 for spreading an adhesive on the edges of the rectangular pieces of wheat straw; a rolling step 40 for performing a rolling to firmly join the adhesive spread edges of the rectangular pieces of wheat straw; a finely cleaving step 50 for finely cleaving the joined pieces of wheat straw into a plurality of yarns; and a winding step 60 for winding the yarns on a spool.

1 Claim, 3 Drawing Sheets

Fig. 3A
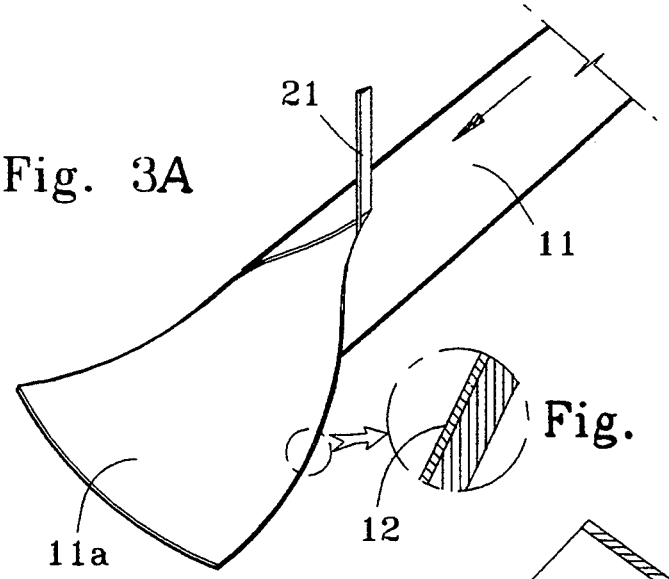
Fig. 3B
Fig. 4
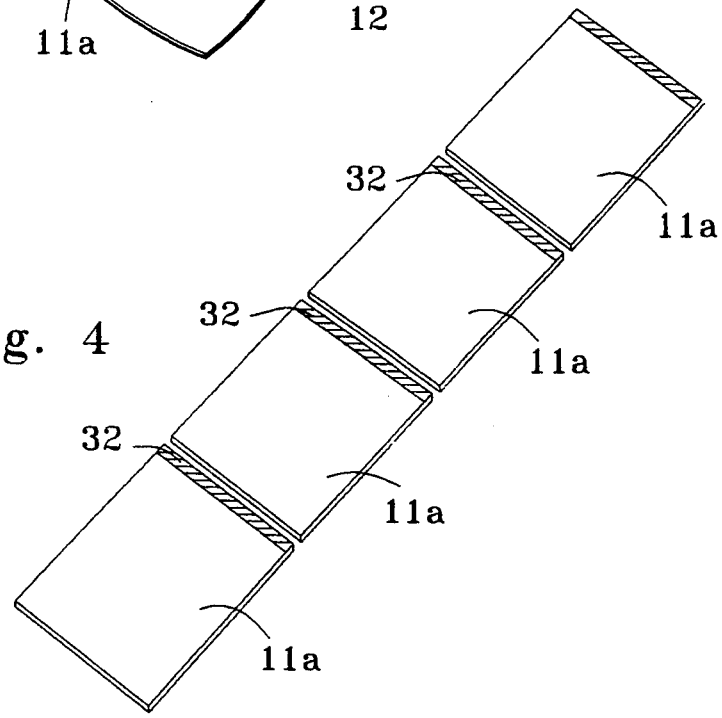
Fig. 5
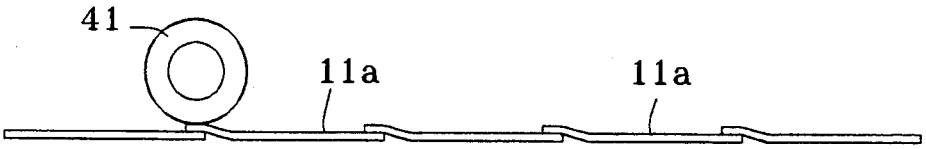

PROCESS FOR MANUFACTURING YARN FROM WHEAT STRAWS

FIELD OF THE INVENTION

The present invention relates to a process for manufacturing yarns from wheat straws. More specifically, the present invention relates to a process for manufacturing yarns from wheat straws, in which wheat straws that are capable of protecting human bodies from harmful spectra such as ultra-violet rays are finely cleaved to prepare yarns in a simple process for making hats, gowns, gloves and the like, so that workers working in the field can be protected from harmful spectra such as ultraviolet rays.

BACKGROUND OF THE INVENTION

Generally, wheat straws have cellulose layers containing lignin, and these cellulose layers are those portions which shine.

Meanwhile, chloro-fluoro-methane which is widely used as sprayers and refrigerants destroys the ozone layer of the earth, with the result that ultra-violet rays and other unknown harmful rays reaches the human bodies, thereby causing dermatic cancer or the like.

Wheat straws having the cellulose layer containing lignin shields (reflects) the harmful rays, and therefore, wheat straw hats have been used since a long time. However, in the past, there has been no method for processing wheat straws, and therefore, hats and baskets have been made of the natural wheat straws without processing.

Because the unprocessed wheat straws were used, there was a limit to making articles for protecting human bodies.

SUMMARY OF THE INVENTION

Therefore it is the object of the present invention to provide a process for manufacturing yarns from wheat straws, in which yarns are made from wheat straws having such superior characteristics, fabrics are formed from the yarns, and garments, hats, gloves and the like are made with the fabrics, so that people working in the open field for long hours can be protected from the harmful ultra-violet rays.

BRIEF DESCRIPTION OF THE DRAWINGS

The above object and other advantages of the present invention will become more apparent by describing in detail the preferred embodiment of the present invention with reference to the attached drawings in which:

FIGS. 3 to 6 illustrate the process of the present invention in partial forms, in which:

FIG. 3 illustrates a wheat straw cleaving process;

FIG. 4 illustrates an adhesive spreading process;

FIG. 5 illustrates a rolling process; and

FIG. 6 illustrates a finely cleaving process; and

DESCRIPTION OF THE PREFERRED EMBODIMENT

Figure 1:
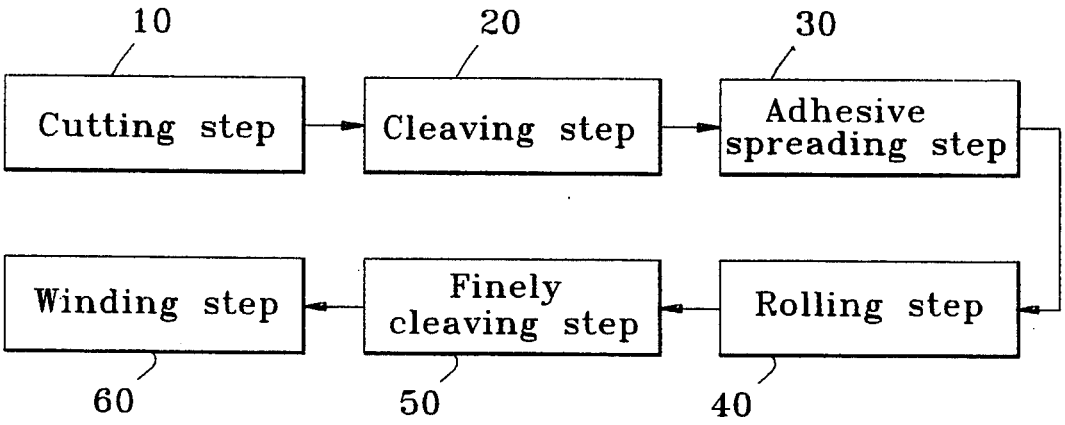
FIG. 1 is a block diagram showing the constitution of the process according to the present invention.
Figure 2:
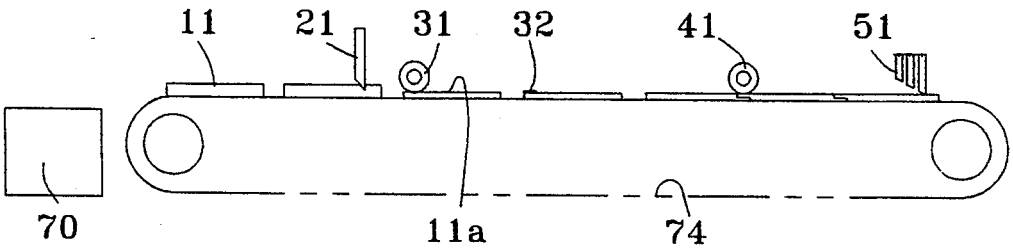
FIG. 2 is a schematic view showing the total process according to the present invention.

As shown in FIGS. 1 and 2, the process for manufacturing yarns from wheat straws according to the present invention includes: a cutting step 10 for cutting off the nodes of the opposite ends of wheat straws after flaying the skins and arranging them neatly; a cleaving step 20 for cleaving the cut pieces of the wheat straws so as for them to become rectangular forms; an adhesive spreading step 30 for spreading an adhesive on the edges of the rectangular pieces of the wheat straws; a rolling step 40 for performing a rolling to join the adhesive spread edges of the rectangular pieces of the wheat straws; a finely cleaving step 50 for finely cleaving the joined pieces of wheat straw into a plurality of yarns; and a winding step 60 for winding the yarns on a spool.

At the cutting step 10, the skin of the wheat straw is flayed, and the inner portion of the wheat straw is used. Further, the nodes of the wheat straws are cut off, so that the tubular wheat straw should become about 30 cm.

Figure 7:
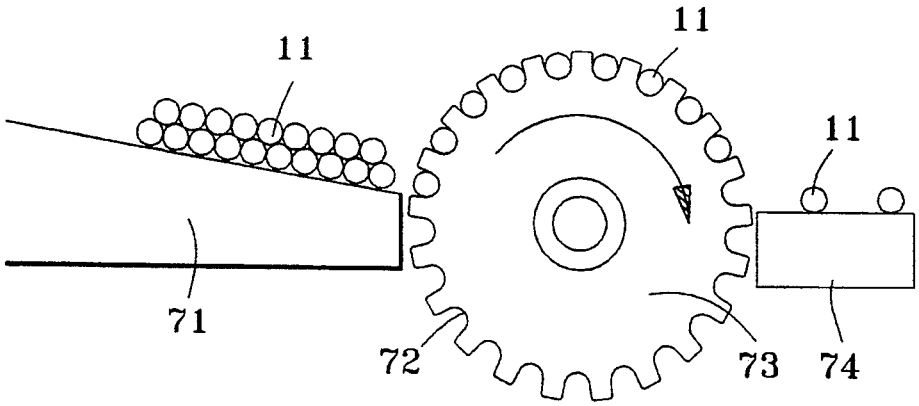
FIG. 7 illustrates a device for supplying the cut wheat straws to the cleaving process.

Such cut wheat straws 11 are stacked on a wheat straw supplying device 70 which is illustrated in FIG. 7. This wheat straw supplying device 70 is provided on a side of it with an inclined shelf 71. Further the wheat straw supplying device 70 is provided with a transferring gear 73 having a plurality of wheat straw placing grooves 72, so that the cut wheat straws can be transferred to the wheat straw cleaving step 20. At the other side of the wheat straw transferring gear 73, there is installed a conveyor 74 which carries the cut wheat straws 11 to the cleaving step 20, after the wheat straws 11 are supplied from the inclined shelf 71.

The wheat straws 11 which have gone through the cutting step 10 are carried one by one by the wheat straw supplying device 70 to the cleaving step 20.

Thus the tubular wheat straws 11 are carried by the conveyor 74 to the cleaving step 20 as shown in FIGS. 2 and 3. The wheat straws 11 which are being carried mounted on the conveyor 74 are cleaved by a knife 21 which is installed above the conveyor 74, with the result that the tubular wheat straws 11 are extended into a rectangular shape.

The wheat straws 11 which have been cleaved by the knife 21 on the conveyor 74 are supplied to the adhesive spreading step 30. At the adhesive spreading step 30, an adhesive 32 is spread on the edges of the extended rectangular wheat straw pieces 11*a* by means of a roller 31.

At the rolling step 40, the extended rectangular wheat straw pieces 11a on which the adhesive is spread are joined together in one row, and a pressing is made by means of a pressing roller 41 having a temperature of 80° C., so that the adhesive should be cured, and the joining of the wheat straw pieces 11*a* should be firmed.

The extended wheat straw pieces 11*a,* which are joined in one row and made plane while passing through the rolling step 40, are cleaved into a plurality of yarns at the finely cleaving step 50.

Figure 6:
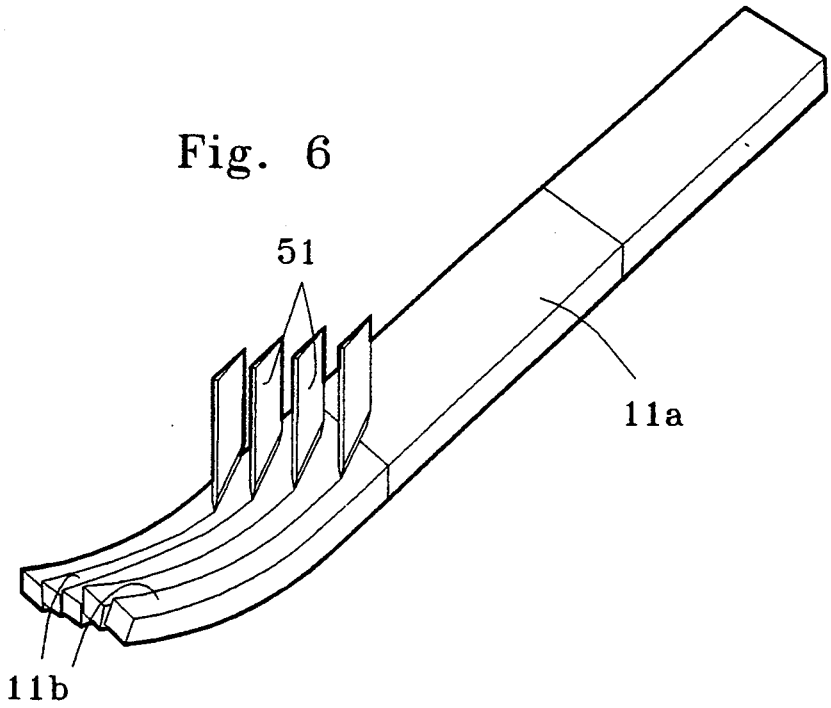

That is, as shown in FIGS. 2 and 6, above the conveyor 74 on which the wheat straw pieces 11*a* are being carried, there are installed a plurality of knives 51 at certain intervals. so that the joined wheat straw pieces lib should be cleaved into a plurality of yarns. The knives 51 can be adjusted as to their intervals.

Thus the wheat straw yarns 11*b* are formed while passing through the finely cleaving step 50, and the wheat straw yarns 11*b* are wound on a spool at the winding step 60, thereby completing the manufacturing of the wheat straw yarns according to the present invention.

In manufacturing the wheat straw yarns as described above, a press roller is used to efficiently carry the yarns before being wound on the spool.

The wheat straw yarns manufactured in the manner as described above is used to make fabrics, and the fabrics thus made are boiled in an aqueous caustic soda solution for a certain period of time. When the fabrics are thus boiled, the stiff wheat straw is softened.

The cellulose layer 12 which exists within the wheat straw is effective in reflecting ultra-violet rays, and therefore, when making the fabrics using the wheat straw yarns, the weaving is made in such a manner that the cellulose layer 12 should be exposed to the outside of the fabrics. That is, the cellulose layers 12 of the longitudinal and lateral yarns should be directed outwardly.

According to the present invention as described above, yarns which contains cellulose layer 12 and lignin capable of shielding ultra-violet rays are manufactured from wheat straws which have been considered useless. Thus wheat straws are turned to a useful material which protects people working in the open fields. Further, the wheat straw yarns are turned to a soft pleasant feeling material by boiling them in an aqueous caustic soda solution.

Further, the natural wheat straws are efficient in the ventilation, and maintain a proper humidity, so that they should be beneficial to the human health. Further, unlike synthetic resins, wheat straws do not cause any environmental contamination.

What is claimed is:

1. A process for manufacturing yarns from wheat straws with nodes comprising:

a cutting step 10 for cutting of the nodes of the opposite ends of wheat straws after flaying the skins and arranging them neatly;

a cleaving step 20 for cleaving the cut pieces of said wheat straws so as to form rectangular pieces;

an adhesive spreading step 30 for spreading an adhesive on an edge of the rectangular pieces of said wheat straws;

a rolling step 40 for performing a rolling operation to firmly join the adhesive spread edges of the rectangular pieces of said wheat straws;

a finely cleaving step 50 for finely cleaving the joined pieces of said wheat straws into a plurality of yarns; and a winding step 60 for winding said yarns on a spool.

* * * * *